US011686514B2

(12) United States Patent
Fang et al.

(10) Patent No.: US 11,686,514 B2
(45) Date of Patent: Jun. 27, 2023

(54) AUTOMATIC OIL LEVEL RETENTION SYSTEM FOR COMPRESSOR AND METHOD FOR CONTROLLING SAME

(71) Applicant: Guangdong Giwee Technology Co. Ltd., Foshan (CN)

(72) Inventors: Ting Fang, Foshan (CN); Yicai Liu, Foshan (CN); Shiqiu Qi, Foshan (CN); Huandi Yang, Foshan (CN)

(73) Assignee: GUANGDONG GIWEE TECHNOLOGY CO. LTD., Foshan (CN)

( * ) Notice: Subject to any disclaimer, the term of this patent is extended or adjusted under 35 U.S.C. 154(b) by 28 days.

(21) Appl. No.: 17/356,671

(22) Filed: Jun. 24, 2021

(65) Prior Publication Data

US 2022/0003468 A1 Jan. 6, 2022

(30) Foreign Application Priority Data

Jun. 24, 2020 (CN) ..... 202010590686.X

(51) Int. Cl.
*F25B 43/02* (2006.01)
*F25B 31/00* (2006.01)
*F25B 49/02* (2006.01)

(52) U.S. Cl.
CPC ..... *F25B 43/02* (2013.01); *F25B 31/004* (2013.01); *F25B 49/022* (2013.01); *F25B 2500/16* (2013.01)

(58) Field of Classification Search
CPC ..... F25B 43/02; F25B 31/004; F25B 49/022; F25B 2500/16
See application file for complete search history.

(56) References Cited

U.S. PATENT DOCUMENTS 5,605,058 A 2/1997 Kurachi et al.
5,884,494 A 3/1999 Okoren et al.
(Continued)

FOREIGN PATENT DOCUMENTS

CN 107228507 A * 10/2017 ..... F25B 31/004
CN 107228507 A 10/2017
EP 3534086 A1 9/2019

OTHER PUBLICATIONS

Pdf file is translation of foreign reference CN107228507A (Year: 2017).*

(Continued)

*Primary Examiner* — Henry T Crenshaw
*Assistant Examiner* — Kamran Tavakoldavani
(74) *Attorney, Agent, or Firm* — Cantor Colburn LLP

(57) ABSTRACT

An automatic oil level retention system for a compressor and a method for controlling a same, including: a normal oil return mode and an auxiliary oil return mode. When a lubricating oil liquid level monitored by a liquid level detection unit in real time is above a required liquid level height, the system initiates only the normal oil return mode; and when the lubricating oil liquid level monitored by the liquid level detection unit in real time is below the required liquid level height, the system initiates the auxiliary oil return mode, and the auxiliary oil return mode is closed and the normal oil return mode is initiated after the lubricating oil liquid level monitored in real time is lifted above the required liquid level height.

10 Claims, 2 Drawing Sheets

(56) References Cited

U.S. PATENT DOCUMENTS

| | | | | |
|---|---|---|---|---|
| 2015/0114013 | A1* | 4/2015 | Joo | F25B 43/02 62/84 |
| 2018/0180333 | A1* | 6/2018 | Sishtla | F25B 31/002 |
| 2021/0348811 | A1* | 11/2021 | Shanmugam | F25B 49/02 |

OTHER PUBLICATIONS

Pdf is translation of foreign reference CN 107228507 A (Year: 2017).*

European Search Report Application No. 21180147.7; dated Nov. 15, 2021; 6 pages.

* cited by examiner

AUTOMATIC OIL LEVEL RETENTION SYSTEM FOR COMPRESSOR AND METHOD FOR CONTROLLING SAME

FOREIGN PRIORITY

This application claims priority to Chinese Patent Application No. 202010590686.X, filed Jun. 24, 2020, and all the benefits accruing therefrom under 35 U.S.C. § 119, the contents of which in its entirety are herein incorporated by reference.

TECHNICAL FIELD

The present disclosure relates to the technical field of air-conditioning systems, and particularly to an air-conditioning system with great comfort dehumidification operation.

BACKGROUND

The existing rolling rotor compressor with a small number of moving parts is widely applied to the fields of household air conditioners and commercial medium and small air conditioners on the strength of the advantages of high reliability, great relative volumetric efficiency and the like. However, since the rolling rotor compressor belongs to one kind of positive displacement compressor, and its cylinder and rolling piston are very sensitive to wet compression, a gas inlet cavity of the compressor is required to be completely filled with refrigerant gases, and compression with liquid is not allowed. Otherwise, such parts as the cylinder and rotor piston of the compressor would be damaged, thereby scrapping the compressor. Furthermore, oil film sealing is needed between the cylinder and the rolling piston, between the rolling piston and a sliding vane, and between an end face of the rolling piston and an inner end face of the cylinder, and the oil film sealing line is so long that a certain lubricating oil liquid level height is required to be maintained at any time in the working process of the compressor, so as to guarantee that excellent oil films are formed on respective oil film sealing end faces of the compressor to achieve the effects of lubrication, sealing, cooling and the like. Once the lubricating oil liquid level is reduced to be below the lowest liquid level, the lubricating system cannot normally work, so that the rolling rotor of the rolling rotor compressor or the scroll plate of the scroll compressor cannot be well lubricated, sealed and cooled, thereby resulting in abrasion or overheating of the moving parts and cylinder clamping of the compressor or overheating or even burning of the motor. In addition, if excessive lubricating oil enters the refrigeration system, heat exchange efficiency of the heat exchanger will be reduced.

In view of the above problems, in order to ensure normal operation of the air conditioner, it must be guaranteed that the oil level with the lowest liquid level and the oil pump form liquid seal during the operation of the compressor, so as to meet basic requirements of the working operation.

SUMMARY

An object of the present invention lies in overcoming deficiencies of the prior art by providing an automatic oil level retention system for a compressor and a method for controlling a same, which can always maintain the oil level of the compressor at an appropriate height and significantly improve operation reliability of the compressor.

In order to achieve the above object, the present invention provides an automatic oil level retention system for a compressor. The automatic oil level retention system for a compressor includes a compressor body, a first gas-liquid separator and a low-pressure gas-liquid separator. Therein, an outlet of the first gas-liquid separator is connected to the compressor body through a gas inlet pipe; an oil return hole of the low-pressure gas-liquid separator is connected to an inlet of the first gas-liquid separator through a gas return pipe; an inlet of the low-pressure gas-liquid separator is provided with an inlet pipe available for being connected by a preset refrigeration system. The automatic oil level retention system for a compressor further comprises an oil return auxiliary loop and a liquid level detection unit. Therein, an inlet and an outlet of the oil return auxiliary loop are connected to a bottom of the low-pressure gas-liquid separator and the inlet of the first gas-liquid separator, respectively; and the liquid level detection unit is disposed in an inner cavity of the first gas-liquid separator and is configured to monitor lubricating oil liquid level conditions within the first gas-liquid separator in real time, so that on/off of the oil return auxiliary loop is correspondingly controlled according to the lubricating oil liquid level conditions monitored in real time.

Furthermore, the oil return auxiliary loop comprises an oil return pipe and an oil return electromagnetic valve disposed on the oil return pipe. An inlet of the oil return pipe is connected to the bottom of the low-pressure gas-liquid separator and an outlet of the oil return pipe is connected to the inlet of the first gas-liquid separator.

Furthermore, based on the lubricating oil liquid level conditions monitored by the liquid level detection unit in real time, the oil return electromagnetic valve is opened or closed correspondingly. Therein, the other two interfaces of the three-way interface are provided for being connected by the gas return pipe and the oil return pipe, respectively.

Furthermore, the inlet of the first gas-liquid separator is connected to an interface of a preset three-way interface, and the other two interfaces of the three-way interface are provided for being connected by the gas return pipe and the oil return pipe, respectively.

Furthermore, the compressor body is a rolling rotor compressor.

Furthermore, the liquid level detection unit is any one of a ball float valve, a liquid level sensor and a liquid level detection control switch.

Furthermore, an oil return flow path of the gas return pipe is longer than an oil return flow path of the oil return pipe.

The present invention further provides a method for controlling an automatic oil level retention system for a compressor. The system comprises a normal oil return mode and an auxiliary oil return mode. Therein, when the lubricating oil liquid level monitored by the liquid level detection unit in real time is above the required liquid level height, the system initiates only the normal oil return mode, and when the lubricating oil liquid level monitored by the liquid level detection unit in real time is below the required liquid level height, the system initiates the auxiliary oil return mode, and the auxiliary oil return mode is closed and the normal oil return mode is initiated after the lubricating oil liquid level monitored in real time is lifted above the required liquid level height.

Furthermore, an oil circuit in the normal oil return mode is as follows: the lubricating oil stored in the low-pressure gas-liquid separator flows into the first gas-liquid separator through the oil return hole and the gas return pipe, while the lubricating oil within the first gas-liquid separator flows into the compressor body through the gas inlet pipe.

Furthermore, an oil circuit in the auxiliary oil return mode is as follows: the system maintains the oil circuit in the normal oil return mode to be smooth, while initiating the oil return auxiliary loop to open the oil return electromagnetic valve, so that the lubricating oil remaining at the bottom of the low-pressure gas-liquid separator flows into the first gas-liquid separator through the oil return pipe and the oil return electromagnetic valve, and meanwhile, the lubricating oil within the first gas-liquid separator flows into the compressor body through the gas inlet pipe.

Advantageous effects for the present invention which adopts the above solutions lie in: monitoring, in real time, the lubricating oil liquid level height during operation, so that the auxiliary oil return mode is initiated in a timely and efficient manner when the lubricating oil liquid level height is below the required liquid level height, and the oil return auxiliary loop is initiated, to accelerate the lubricating oil flow from the low-pressure gas-liquid separator into the first gas-liquid separator and to increase the lubricating oil liquid level height of the first gas-liquid separator, thereby guaranteeing that the compressor body can maintain appropriate lubrication, sealing and cooling and improving the lubricating property and operation reliability of the compressor body.

Figure 1:
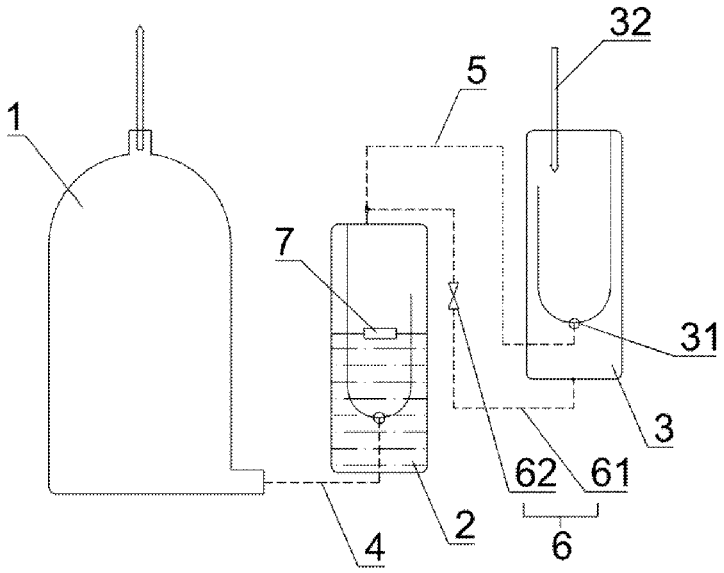
FIG. 1 is a schematic diagram of an oil level retention system according to the present invention.

Reference signs: a compressor body 1; a first gas-liquid separator 2; a low-pressure gas-liquid separator 3; an oil return hole 31; an inlet pipe 32; a gas inlet pipe 4; a gas return pipe 5; an oil return auxiliary loop 6; an oil return pipe 61; an oil return electromagnetic valve 62; a liquid level detection unit 7.

DETAILED DESCRIPTION

To facilitate an understanding of the present invention, the present invention is described below more thoroughly with reference to the accompanying drawings. Preferred embodiments of the present invention are shown in the accompanying drawings. The present invention may, however, be implemented in many different ways, not limited to the embodiments set forth in the present disclosure. The purpose of providing these embodiments is to make the disclosure of the present invention understood more thoroughly and comprehensively.

With reference to FIG. 1, an automatic oil level retention system for a compressor includes a compressor body 1, a first gas-liquid separator 2, a low-pressure gas-liquid separator 3, an oil return auxiliary loop 6 and a liquid level detection unit 7. Therein, the first gas-liquid separator 2 may be provided in the compressor body 1 itself, or may be configured separately externally, which specifically depends on the model and specification of the compressor actually used, without any limitation set herein.

Further, the compressor body 1 according to the present embodiment is a rolling rotor compressor; and the liquid level detection unit 7 is any one of a ball float valve, a liquid level sensor and a liquid level detection control switch.

In the present embodiment, an outlet of the first gas-liquid separator 2 is connected to an inlet of the compressor body 1 through a gas inlet pipe 4; an oil return hole 31 of the low-pressure gas-liquid separator 3 is connected to an inlet of the first gas-liquid separator 2 through a gas return pipe 5; an inlet of the low-pressure gas-liquid separator 3 is provided with an inlet pipe 32 for being connected by a preset refrigeration system (the inlet pipe 32 is generally connected to an evaporator of the refrigeration system, without any limitation set herein, and persons skilled in the art can adaptively adjust the connection according to constitution of the actual refrigeration system); and an outlet of the compressor body 1 is connected to the refrigeration system, so that the oil level retention system is connected to the refrigeration system.

Further, the inlet of the first gas-liquid separator 2 is connected to an interface of a preset three-way interface; and the other two interfaces of the three-way interface are provided for being connected by the gas return pipe 5 and the oil return pipe 61, respectively.

In the present embodiment, the oil return auxiliary loop 6 includes an oil return pipe 61 and an oil return electromagnetic valve 62 disposed on the oil return pipe 61. Therein, an inlet of the oil return pipe 61 is connected to a bottom of the low-pressure gas-liquid separator 3, and an outlet thereof is connected to the inlet of the first gas-liquid separator 2, so that an inlet and an outlet of the oil return auxiliary loop 6 are connected to the bottom of the low-pressure gas-liquid separator 3 and the inlet of the first gas-liquid separator 2, respectively. The oil return electromagnetic valve 62 in the present embodiment is correspondingly controlled to be opened or closed based on lubricating oil liquid level conditions monitored by the liquid level detection unit 7 in real time, thereby realizing on/off control of the oil return auxiliary loop 6.

Specifically, when the lubricating oil liquid level monitored by the liquid level detection unit 7 in real time is above the required liquid level height, it is meant that the flow rate of refrigerant and lubricating oil remaining in the low-pressure gas-liquid separator 3 flowing into the first gas-liquid separator 2 is a normal flow rate, and only the lubricating oil within the low-pressure gas-liquid separator 3 flows into the first gas-liquid separator 2 through the gas return pipe 5 only. On the contrary, when the lubricating oil liquid level monitored by the liquid level detection unit 7 in real time is below the required liquid level height, it is meant that the flow rate of refrigerant and lubricating oil remaining in the low-pressure gas-liquid separator 3 flowing into the first gas-liquid separator 2 is insufficient, and the lubricating oil within the low-pressure gas-liquid separator 3 at this time not only flows into the first gas-liquid separator 2 through the gas return pipe 5, but also the oil return auxiliary loop 6 is additionally initiated, so that the flow rate of the lubricating oil flowing into the first gas-liquid separator 2 is increased.

For ease of understanding, the oil level retention system described above is further explained below in conjunction with a specific control method.

Figure 2:
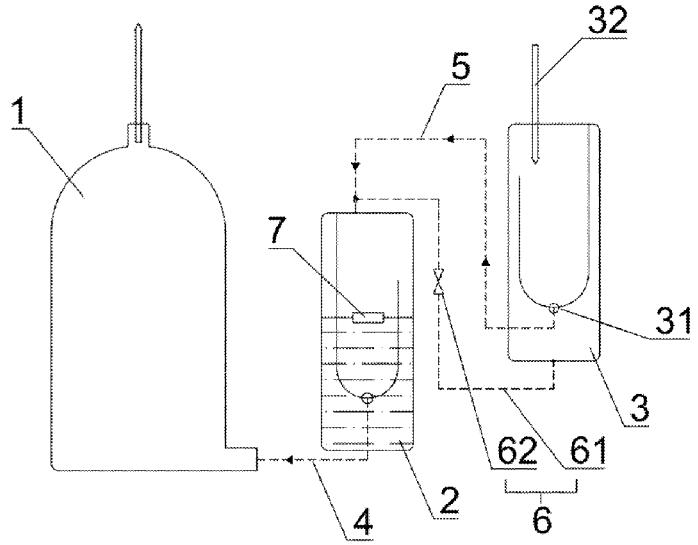
FIG. 2 is a schematic diagram of an oil circuit in a normal oil return mode according to the present invention.

In the present embodiment, the system includes a normal oil return mode and an auxiliary oil return mode. With reference to FIG. 2, an oil circuit in the normal oil return mode is as follows: lubricating oil of the low-pressure gas-liquid separator 3 flows into the first gas-liquid separator 2 through the oil return hole 31 and the gas return pipe 5. Meanwhile, lubricating oil within the first gas-liquid separator 2 flows into the compressor body 1 through the gas inlet pipe 4 so as to supplement the lubricating oil within the compressor body 1. Through the above oil circuit, the lubricating oil stored in the low-pressure gas-liquid separator 3 enters the first gas-liquid separator 2 through the oil return hole 31 and the gas return pipe 5 to complete gas-liquid separation and oil return. As such, the lubricating oil of the first gas-liquid separator 2 can be maintained at an appropriate liquid level height, and meanwhile, no excessive lubricating oil is allowed to enter the compressor body 1 and the refrigeration system for circulation.

Figure 3:
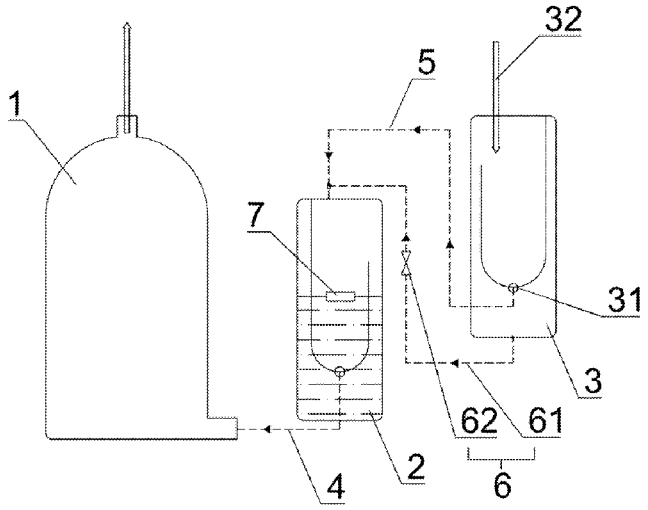
FIG. 3 is a schematic diagram of an oil circuit in an auxiliary oil return mode according to the present invention.

In the present embodiment, with reference to FIG. 3, an oil circuit in the auxiliary oil return mode is as follows: the system maintains the oil circuit in the normal oil return mode to be smooth, while initiating the oil return auxiliary loop 6 to open the oil return electromagnetic valve 62, so that the lubricating oil remaining at the bottom of the low-pressure gas-liquid separator 3 enters the first gas-liquid separator 2 through the oil return pipe 61 and the oil return electromagnetic valve 62. Moreover, lubricant flowing from the oil return auxiliary loop 6 and lubricating oil flowing from the oil return pipe 61 are mixed within the first gas-liquid separator 2 and are subjected to gas-liquid separation treatment, before flowing into the compressor body 1 through the gas inlet pipe 4, whereby it is possible not only to supplement the lubricating oil within the compressor body 1, but also to gradually lift the lubricating oil within the first gas-liquid separator 2 to an appropriate liquid level height.

Further, when the liquid level detection unit 7 has monitored in real time the lubricating oil liquid level within the first gas-liquid separator 2 to be above the required liquid level height, the normal oil return mode is initiated.

Further, when the liquid level detection unit 7 has monitored in real time the lubricating oil liquid level within the first gas-liquid separator 2 to be below the required liquid level height, the auxiliary oil return mode is initiated, and after the lubricating oil liquid level within the first gas-liquid separator 2 has been monitored in real time to be above the required liquid level height, the auxiliary oil return mode is closed and the normal oil return mode is initiated.

Further, the required liquid level height specified in the present embodiment is determined by the model and specification of the actual compressor, and can be adaptively adjusted by those skilled in the art according to actual circumstances, without any limitation set herein.

In the present embodiment, when the compressor body 1 is operated under a low-load working condition, a low requirement is set for the flow rate of the refrigerant, and the low-flow refrigerant at this time is not enough to ensure that the flow rate from the low-pressure gas-liquid separator 3, through the gas return pipe 5 to the first gas-liquid separator 2 reaches a predetermined flow rate (between 3.6 m/s and 7.2 m/s), thereby making it impossible to guarantee that the refrigerant and the lubricating oil remaining in the low-pressure gas-liquid separator 3 enter the first gas-liquid separator 2 through the gas return pipe 5. The lubricating oil liquid level height of the first gas-liquid separator 2 gradually decreases along with continuous operation of the compressor body 1. When the lubricating oil liquid level height is below the required liquid level height, the auxiliary oil return mode needs to be initiated, and the refrigerant and the lubricating oil are made to flow into the first gas-liquid separator 2 by means of both the gas return pipe 5 and the oil return auxiliary loop 6.

Accordingly, the lubricating oil liquid level height within the first gas-liquid separator 2 is guaranteed by means of the above normal oil return mode and auxiliary oil return mode, so that the compressor can be guaranteed to sufficiently lubricated at any time. Meanwhile, no excessive lubricating oil remain in the compressor body 1, thereby avoiding an unduly great amount of lubricating oil from flowing into the refrigeration system due to too much lubricating oil within the compressor body 1 to result in adverse problems such as influence on heat exchange efficiency and too much oil load.

Oil return power in the normal oil return mode or the auxiliary oil return mode according to the present embodiment comes from two aspects, namely, a pressure differential between the low-pressure gas-liquid separator 3 and the first gas-liquid separator 2, and gas suction of the compressor body 1. Since the gas return pipe 5 between the low-pressure gas-liquid separator 3 and the first gas-liquid separator 2 has such a length that the gas return pipe 5 is longer than a length of the oil return flow path of the oil return pipe 61. Meanwhile, due to intrinsic roughness of the interior of the pipe and viscosity of the refrigerant, there is some flow resistance, so that flow resistance of the oil return pipe 61 is smaller than that of the gas return pipe 5, thereby generating an inherent oil return pressure differential.

The foregoing embodiments are merely preferred embodiments of the present invention, and are not intended to restrict the present invention in any way. More possible changes and modifications made to the technical solution of the present invention by any person skilled in the art by use of the technical contents suggested above without departing from the scope of the technical solution of the present invention all are equivalent embodiments of the present invention. Therefore, any equivalent change made in light of the idea of the present invention without departing from the contents of the technical solution of the present invention shall all be included within the protection scope of the present invention.

What is claimed is:

1. An automatic oil level retention system for a compressor, comprising: a compressor body (1), a first gas-liquid separator (2) and a low-pressure gas-liquid separator (3), wherein an outlet of the first gas-liquid separator (2) is connected to the compressor body (1) through a gas inlet pipe (4), an oil return hole (31) of the low-pressure gas-liquid separator (3) is connected to an inlet of the first gas-liquid separator (2) through a gas return pipe (5), and an inlet of the low-pressure gas-liquid separator (3) is provided with an inlet pipe (32) for being connected by a preset refrigeration system; and further comprising: an oil return auxiliary loop (6) and a liquid level detection unit (7), wherein an inlet and an outlet of the oil return auxiliary loop (6) are connected to a bottom of the low-pressure gas-liquid separator (3) and the inlet of the first gas-liquid separator (2), respectively, and wherein the liquid level detection unit (7) is disposed in an inner cavity of the first gas-liquid separator (2) and is configured to monitor lubricating oil liquid level conditions within the first gas-liquid separator (2) in real time, wherein the oil return auxiliary loop (6) comprises an oil return pipe (61) and an oil return valve (62) disposed on the oil return pipe (61), wherein the oil return valve (62) is opened or closed is in response the lubricating oil liquid level conditions.

2. The automatic oil level retention system for the compressor as claimed in claim 1, wherein an inlet of the oil return pipe (61) is connected to the bottom of the low-pressure gas-liquid separator (3) and an outlet of the oil return pipe (61) is connected to the inlet of the first gas-liquid separator (2).

3. The automatic oil level retention system for the compressor as claimed in claim 2, wherein based on the lubricating oil liquid level conditions monitored by the liquid level detection unit (7) in real time, the oil return valve (62) is opened or closed correspondingly, wherein when the monitored lubricating oil liquid level is above a required liquid level height, the oil return valve (62) is closed, and when the monitored lubricating oil liquid level is below the required liquid level height, the oil return valve (62) is opened.

4. The automatic oil level retention system for the compressor as claimed in claim 2, wherein the inlet of the first gas-liquid separator (2) is connected to an interface of a preset three-way interface, wherein the other two interfaces of the three-way interface are provided for being connected by the gas return pipe (5) and the oil return pipe (61), respectively.

5. The automatic oil level retention system for the compressor as claimed in claim 1, wherein the compressor body (1) is a rolling rotor compressor.

6. The automatic oil level retention system for the compressor as claimed in claim 1, wherein the liquid level detection unit (7) is any one of a ball float valve, a liquid level sensor and a liquid level detection control switch.

7. The automatic oil level retention system for the compressor as claimed in claim 1, wherein an oil return flow path of the gas return pipe (5) is longer than an oil return flow path of the oil return pipe (61).

8. A method for controlling the automatic oil level retention system for the compressor as claimed in claim 1, wherein the system comprises a normal oil return mode and an auxiliary oil return mode, wherein when the lubricating oil liquid level monitored by the liquid level detection unit (7) in real time is above the required liquid level height, the system initiates only the normal oil return mode, and when the lubricating oil liquid level monitored by the liquid level detection unit (7) in real time is below the required liquid level height, the system initiates the auxiliary oil return mode, and the auxiliary oil return mode is closed and the normal oil return mode is initiated after the lubricating oil liquid level monitored in real time is lifted above the required liquid level height.

9. The method for controlling the automatic oil level retention system for the compressor according to claim 8, wherein an oil circuit in the normal oil return mode is as follows: lubricating oil stored in the low-pressure gas-liquid separator (3) flows into the first gas-liquid separator (2) through the oil return hole (31) and the gas return pipe (5), while lubricating oil within the first gas-liquid separator (2) flows into the compressor body (1) through the gas inlet pipe (4).

10. The method for controlling the automatic oil level retention system for the compressor according to claim 8, wherein an oil circuit in the auxiliary oil return mode is as follows: the system maintains the oil circuit in the normal oil return mode to be smooth, while initiating the oil return auxiliary loop (6) to open the oil return valve (62), so that lubricating oil remaining at the bottom of the low-pressure gas-liquid separator (3) flows into the first gas-liquid separator (2) through the oil return pipe (61) and the oil return valve (62), and meanwhile, the lubricating oil within the first gas-liquid separator (2) flows into the compressor body (1) through the gas inlet pipe (4).

* * * * *